US008074616B2

(12) United States Patent
Rolland et al.

(10) Patent No.: US 8,074,616 B2
(45) Date of Patent: Dec. 13, 2011

(54) ENGINE AIR INTAKE MANIFOLD HAVING A SHELL

(75) Inventors: Francis V. Rolland, Rochester Hills, MI (US); Thomas E. Rossman, Rochester Hills, MI (US); Allen G. Crowley, Rubicon Township, MI (US); Raffik Said, Rochester, MI (US)

(73) Assignee: Mark IV Systemes Moteurs USA, Inc., Rochester Hills, MI (US)

( * ) Notice: Subject to any disclaimer, the term of this patent is extended or adjusted under 35 U.S.C. 154(b) by 562 days.

(21) Appl. No.: 12/189,370

(22) Filed: Aug. 11, 2008

(65) Prior Publication Data

US 2010/0031912 A1 Feb. 11, 2010

(51) Int. Cl.
*F02M 35/10* (2006.01)

(52) U.S. Cl. ..... 123/184.21; 123/195 C; 123/198 E; 220/519; 220/781; 220/4.26

(58) Field of Classification Search ..... 123/184.21–184.61, 195 C, 198 E; 220/213, 519, 781, 4.26; 29/890.08; 72/379.6
See application file for complete search history.

(56) References Cited

U.S. PATENT DOCUMENTS 2,840,179 A 6/1958 Junger
3,845,593 A 11/1974 Zen
4,080,945 A 3/1978 Hikosaka et al.
4,304,821 A 12/1981 Hayase et al.
4,343,409 A 8/1982 Silver
4,372,120 A 2/1983 Ford, Jr. et al.
4,428,331 A 1/1984 Zang et al.
4,487,291 A 12/1984 Walker
4,531,609 A 7/1985 Wolf et al.
4,741,295 A * 5/1988 Hosoya et al. ..... 123/184.31
5,064,968 A 11/1991 Kovacs et al.
5,243,933 A 9/1993 Mukawa
6,050,236 A 4/2000 Sawaki et al.
6,085,924 A 7/2000 Henderson
6,116,206 A 9/2000 Krentz
6,199,530 B1 3/2001 Brassell et al.
6,213,073 B1 4/2001 Iwata
6,401,966 B2 6/2002 Tsai
6,490,778 B1 * 12/2002 Funatsu et al. ..... 29/557
6,581,561 B1 6/2003 Brodesser et al.
6,679,215 B2 * 1/2004 Benson et al. ..... 123/184.34
7,082,915 B2 8/2006 Tanikawa et al.
2005/0263143 A1 * 12/2005 Matsuoka et al. ..... 123/572

* cited by examiner

*Primary Examiner* — Noah Kamen
*Assistant Examiner* — Hung Q Nguyen
(74) *Attorney, Agent, or Firm* — Thompson Hine LLP

(57) ABSTRACT

Apparatus includes a motor-vehicle, internal-combustion-engine air intake manifold having an intake-manifold first shell attachable or monolithically joined to an intake-manifold second shell to surround an internal manifold volume. The first shell has a wall with at least a portion having undulating concave and convex regions as defined exterior to the internal manifold volume of the attached or monolithically-joined first shell and second shell.

16 Claims, 4 Drawing Sheets

ENGINE AIR INTAKE MANIFOLD HAVING A SHELL

TECHNICAL FIELD

The present invention relates generally to engines, and more particularly to an engine air intake manifold having a shell.

BACKGROUND OF THE INVENTION

Motor vehicles, such as automobiles, include those having internal combustion engines which include an air intake manifold having a first shell and a second shell. The second shell is mounted to a portion of the engine, and the first shell is attached (such as at fixing locations on the perimeter rim of the cover) to the second shell to surround an internal manifold volume. The intake-manifold first shell has raised sides and a substantially flat top. In some conventional designs, the top of the first shell includes fixing locations for fasteners extending from the top of the first shell to the second shell of the air intake manifold and includes added ribs all to improve both pressure resistance to sudden pressurization (as from an engine backfire) and acoustical barrier properties. Multi-layered air intake manifolds having three or four shells are also known.

What is needed is an improved engine air intake manifold having a shell.

SUMMARY OF THE INVENTION

A first expression of an embodiment of the invention is for apparatus including a motor-vehicle, internal-combustion-engine air intake manifold having an intake-manifold first shell attachable or monolithically joined to an intake-manifold second shell to surround an internal manifold volume. The first shell has a wall with at least a portion having undulating concave and convex regions as defined exterior to the internal manifold volume of the attached or monolithically-joined first shell and second shell.

A second expression of an embodiment of the invention is for apparatus including a motor-vehicle, internal-combustion-engine air intake manifold having an intake-manifold first shell attachable or monolithically joined to an intake-manifold second shell to surround an internal manifold volume. The first shell has a wall with at least a portion having undulating concave and convex regions as defined exterior to the internal manifold volume of the attached or monolithically-joined first shell and second shell. The first shell has a plurality of substantially-circular ribs each surrounding and concentric with a center of a corresponding concave region. The first shell has an elongated rib extending from each substantially-circular rib to a neighboring substantially-circular rib.

A third expression of an embodiment of the invention is for apparatus including a motor-vehicle, internal-combustion-engine air intake manifold having an intake-manifold first shell attachable to an intake-manifold second shell to surround an internal manifold volume. The first shell has a wall with at least a portion having undulating concave and convex regions as defined exterior to the internal manifold volume of the attached first shell and second shell. The first shell has a plurality of fixing locations, wherein the first shell is attachable at the fixing locations to the second shell. The fixing locations are centered on the centers of the concave regions.

Several benefits and advantages are derived from one or more or all of the expressions of the embodiment of the invention. In one example, computer aided engineering analysis of one design (which included ribs) of the embodiment of the invention yielded 80%-90% reduction in displacement and 55%-70% reduction in peak stress levels during a sudden pressurization event, compared to a conventional air intake manifold having a shell with a flat top, which should result in improved acoustical barrier properties and improved burst strength.

DETAILED DESCRIPTION

Figure 1:
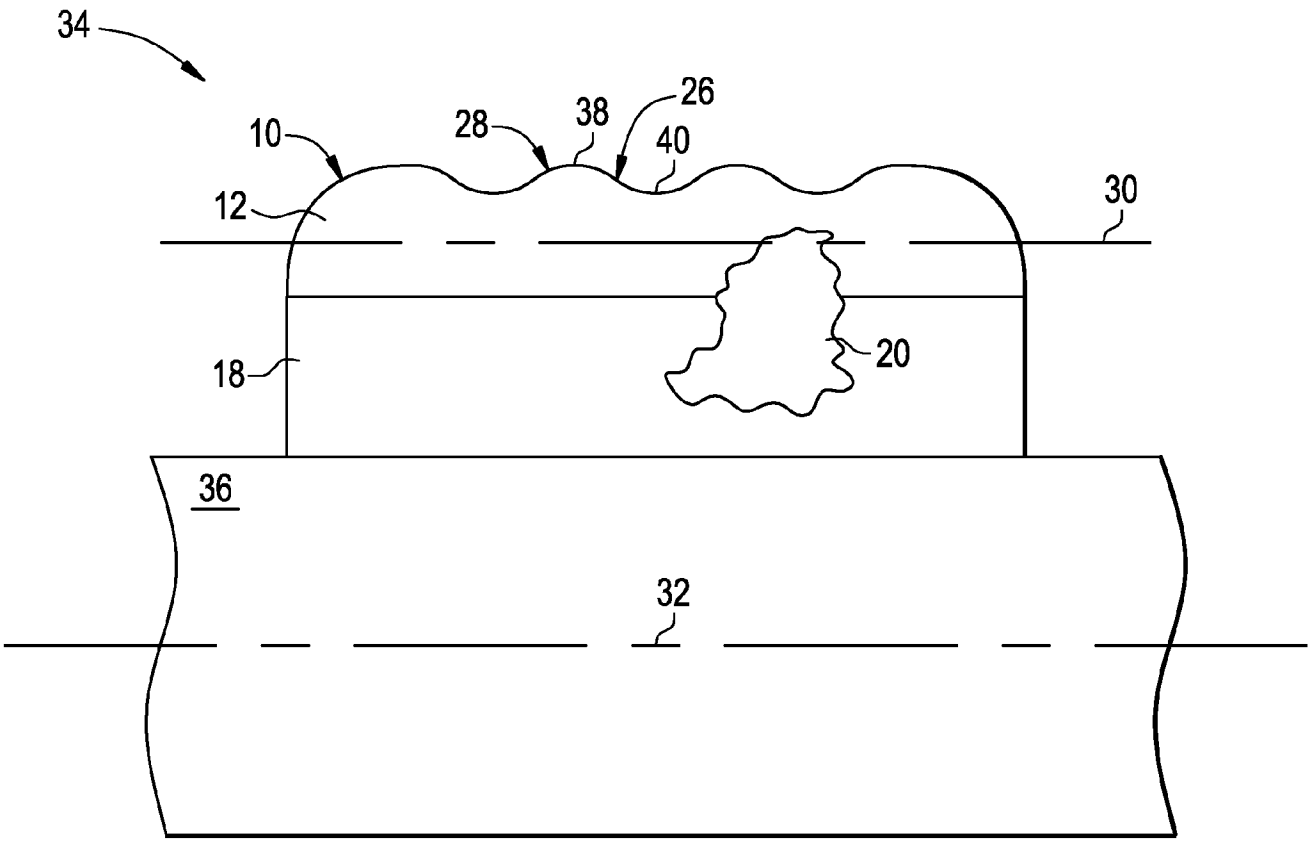
FIG. 1 is a schematic, side-elevational view of an embodiment of the invention showing an air intake manifold including an intake-manifold first shell with its longitudinal axis and also showing an intake-manifold second shell and a portion of a motor-vehicle internal combustion engine with a crankshaft central longitudinal axis, wherein a portion of the air intake manifold is broken away showing the internal manifold volume within the attached first shell and second shell, and wherein fasteners attaching the components together have been omitted for clarity.

Referring now to the drawings, FIGS. 1-4 show an embodiment of the present invention. A first expression of the embodiment of FIGS. 1-4 is for apparatus including a motor-vehicle, internal-combustion-engine air intake manifold 10 having an intake-manifold first shell 12. The first shell 12 is attachable or monolithically joined to an intake-manifold second shell 18 to surround an internal manifold volume 20. The first shell 12 has a wall 22 with at least a portion 24 having undulating concave and convex regions 26 and 28 as defined exterior to the internal manifold volume 20 of the attached or monolithically-joined first shell 12 and second shell 18.

In one application of the first expression of the embodiment of FIGS. 1-4, the first shell 12 has a plurality of fixing locations (such as 14 and/or 16) and is attachable (and in one example is attached) at the fixing locations (such as 14 and/or 16) to the second shell 18. In one modification, not shown, the air intake manifold includes at least one additional shell making the air intake manifold a multi-layer air intake manifold. In one example, the first shell 12 consists essentially of plastic and the second shell 18 consists essentially of aluminum. Other examples are left to those skilled in the art. In a different application, as shown in the different embodiment of FIG. 5, the first shell 112 is monolithically joined to the second shell 118 meaning that the two shells are two portions of a single piece such as, and without limitation, wherein the single-piece air intake manifold 110 is made using blow molding or lost core technology.

Figure 2:
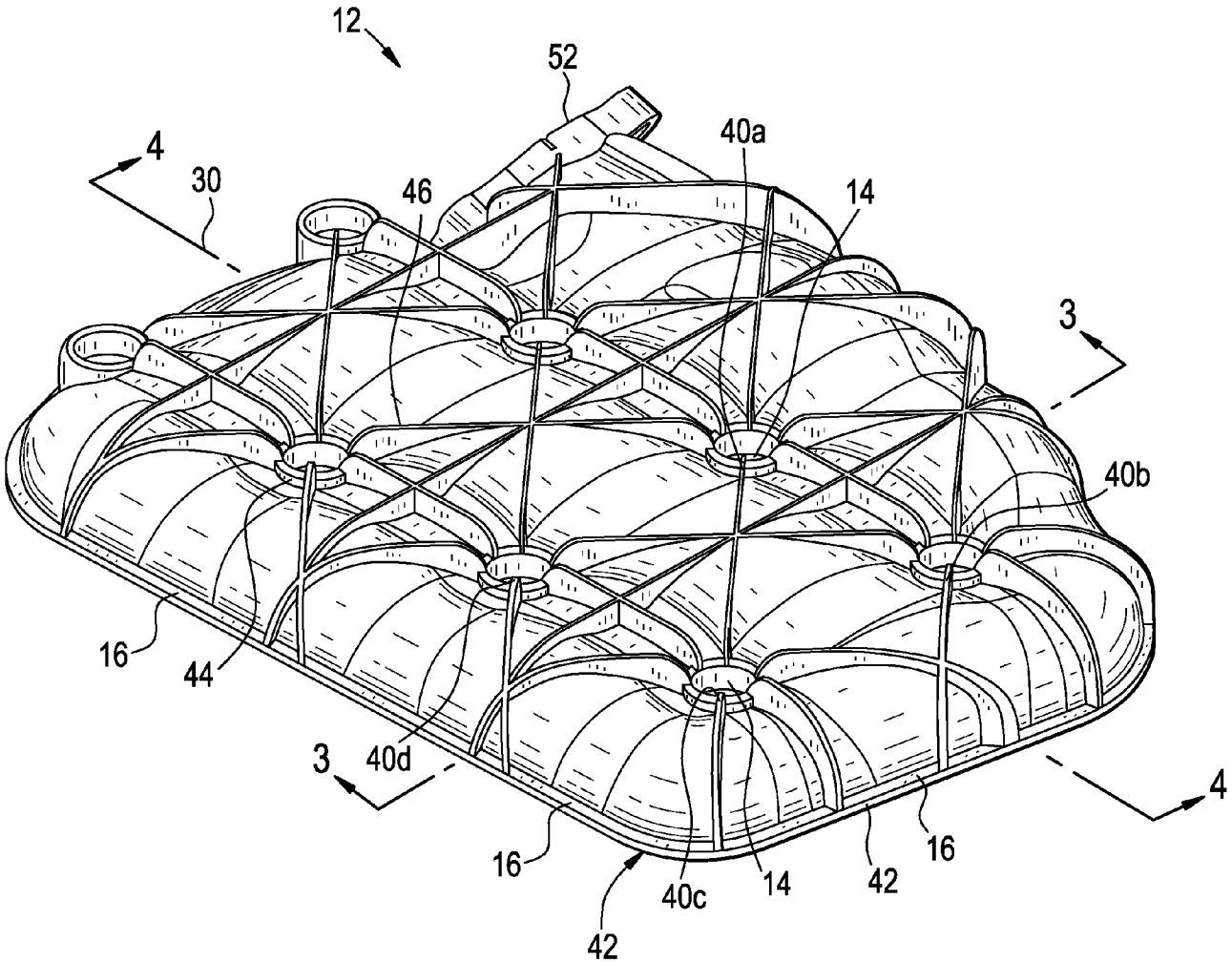
FIG. 2 is a perspective and more detailed view of the intake-manifold first shell of FIG. 1 showing the exterior of the first shell.
Figure 3:
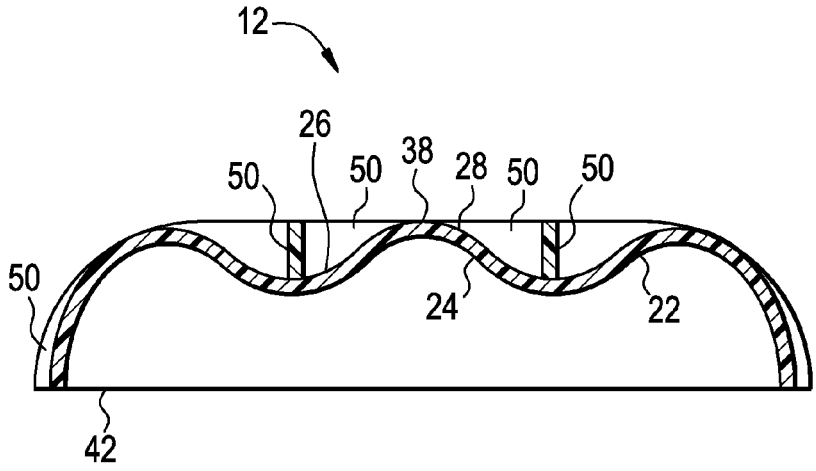
FIG. 3 is a cross-sectional view of the intake-manifold of FIG. 2 taken along lines 3-3 of FIG. 2.
Figure 4:
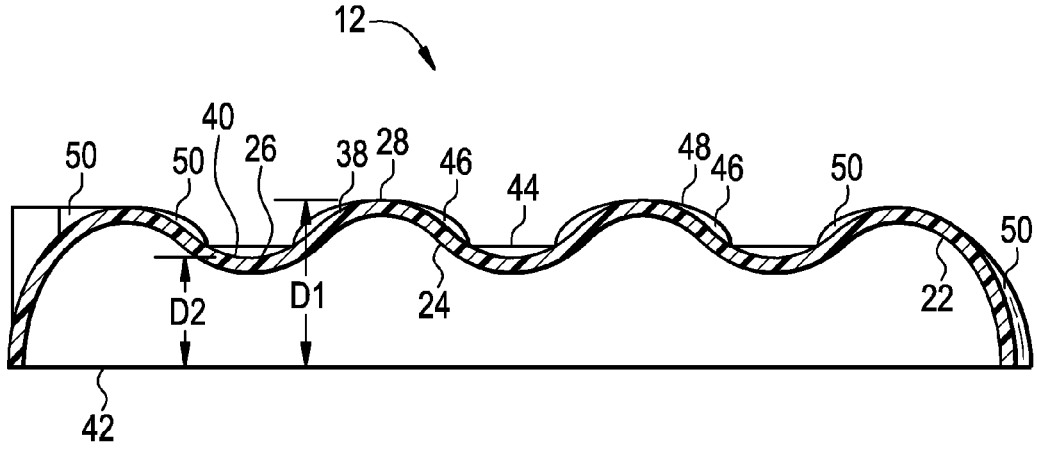
FIG. 4 is a cross-sectional view of the intake-manifold of FIG. 2 taken along lines 4-4 of FIG. 2.
Figure 5:
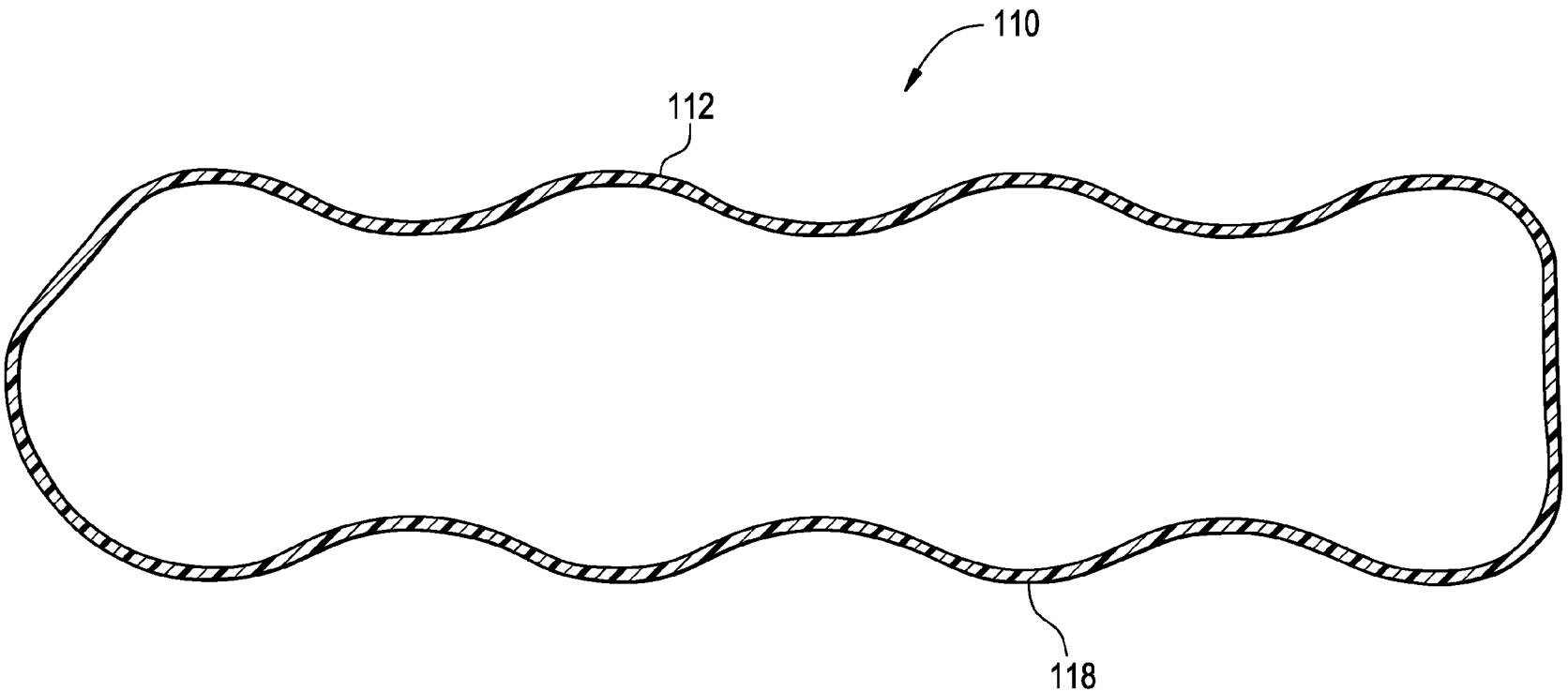
FIG. 5 is a cross-sectional view, as in FIG. 4 but of the first and second shells of a different embodiment of an air intake manifold of the invention wherein the first shell is monolithically joined to the second shell meaning that the two shells are two portions of a single piece.

In one enablement of the first expression of the embodiment of FIGS. 1-4, the first shell 12 has a longitudinal axis 30, and a first cross-sectional view (as seen in FIG. 3) of the first shell 12 taken by a first cutting plane perpendicular to the longitudinal axis 30 shows at least one convex region 28 surrounded by two adjoining concave regions 26. In one example, the first cross-sectional view shows at least three convex regions 28 and at least two concave regions 26. It is noted that the longitudinal axis 30 of the first shell 12 is an axis of the first shell 12 which is, in one option, parallel to a crankshaft central longitudinal axis 32 of an internal combustion engine 34 having a portion 36 (such as an engine block) to which the second shell 18 (such as a cylinder head) is mountable, wherein the longitudinal axis 30 of the first shell 12 and the engine crankshaft central longitudinal axis 32 lie in a same plane. In one variation, a second cross-sectional view (as seen in FIG. 4) of the first shell 12 taken by a second cutting plane containing the longitudinal axis 30 and perpendicular to the first cutting plane shows at least one convex region 28 surrounded by two adjoining concave regions 26. In one example, the second cross-sectional view shows at least four convex regions 28 and at least three concave regions 26. In another configuration, not shown, the air intake manifold has at least one additional shell, wherein the bottom shell is mountable to a portion of the engine.

In one implementation of the first expression of the embodiment of FIGS. 1-4, the convex regions 28 each have a center 38, and the centers 38 of the convex regions 28 lie substantially in a first plane. In one variation, the concave regions 26 each have a center 40, and the centers 40 of the concave regions 26 lie substantially in a second plane parallel to, and spaced apart from, the first plane. In one modification, the first shell 12 includes a perimeter rim 42 (including any outwardly-extending mounting and non-mounting tabs), and the perimeter rim 42 lies substantially in a third plane parallel to, and spaced apart from, the first and second planes, wherein the second plane is disposed between the first and third planes. In one example, the first plane is spaced apart a distance D1 (seen in FIG. 4) from the third plane, the second plane is spaced apart a distance D2 (seen in FIG. 4) from the third plane, and D2/D1 is between and including 0.50 and 0.75.

In one design of the first expression of the embodiment of FIGS. 1-4, D1 has a range from, and including, 3.8 centimeters to 5.2 centimeters, D2 has a range from, and including, 2.3 centimeters to 4.2 centimeters, the first shell 12 has an air intake 52, the wall 22 has a substantially constant wall thickness (apart from any rib and any perimeter rim and any air intake) from, and including, 2.5 millimeters to 3.5 millimeters, and the first shell 12 comprises an injection-molded thermoplastic material (such as filled polyamides such as nylon 6 or nylon 6.6 with glass fill) for reduced cost and weight. Although the wall 22 and the ribs 50 have been shown, for clarity, as separate pieces in FIG. 3, in one configuration, the wall 22 and the ribs 44, 46, and 50 and the air intake 52 are portions of a monolithic structure. In one application, the first shell 12 has a longitudinal length from, and including 31 centimeters to 40 centimeters, and has a transverse width (omitting any mounting and non-mounting tabs of the perimeter rim 42) from, and including 24 centimeters to 31 centimeters.

In one variation of the first expression of the embodiment of FIGS. 1-4, and as can be visualized from FIG. 2, the first shell 12 includes an exterior top surface (minus any ribs) having at least a portion with a multi-pillow top shape which includes one pillow having four sides with each side abutting an additional pillow.

In one construction of the first expression of the embodiment of FIGS. 1-4, as best seen in FIG. 2, the first shell 12 has a plurality of substantially-circular ribs 44 each surrounding and concentric with the center 40 of a corresponding concave region 26. In one variation, the first shell 12 has an elongated rib 46 extending from each substantially-circular rib 44 to a neighboring substantially-circular rib 44. In one modification, the elongated ribs 46 each have a top surface 48, and at least ninety percent of the top surface 48 of each elongated rib 46 lies substantially in the first plane. In one illustration, the first shell 12 has additional ribs 50. It is stressed that for the first shell 12 to have ribs (such as 44, 46, and 50) is optional.

In one application of the first expression of the embodiment of FIGS. 1-4, the first shell 12 has a plurality of fixing locations 14 wherein the first shell 12 is attachable at the fixing locations 14 to the second shell 18, wherein the fixing locations 14 are centered on the centers 40 of the concave regions 26. In one variation, the centers 40 of the concave regions 26 include first, second, third, and fourth centers 40*a*, 40*b*, 40*c*, and 40*d* defining corners of a rectangle, such as a square. In one modification, a line drawn between the first and second centers 40*a* and 40*b* and a line drawn between the third and fourth centers 40*c* and 40*d* each are substantially parallel to the longitudinal axis 30. In the same or a different application, the first shell 12 has a plurality of fixing locations 16, wherein the fixing locations 16 are disposed proximate the perimeter rim 42 (and can even include the entire perimeter rim for adhesive bonding or welding). It is stressed that the locations of the fixing locations need not be at fixing location 14 and need not be at fixing location 16, but that different fixing locations and/or fixing methods may be chosen by those skilled in the art. Although fasteners (as one fixing method) for fixing locations have been omitted from the figures for clarity, such fasteners include, without limitation, mounting screws and other type connections which can, in one example, extend to fasten to a portion 36 (such as an engine block) of the engine 34.

A second expression of the embodiment FIGS. 1-4 is for apparatus including a motor-vehicle, internal-combustion-engine air intake manifold 10 having an intake-manifold first shell 12 attachable or monolithically joined to an intake-manifold second shell 18 to surround an internal manifold volume 20. The first shell 12 has a wall 22 with at least a portion 24 having undulating concave and convex regions 26 and 28 as defined exterior to the internal manifold volume 20 of the attached or monolithically-joined first shell 12 and second shell 18. The first shell 12 has a plurality of substantially-circular ribs 44 each surrounding and concentric with a center 40 of a corresponding concave region 26. The first shell 12 has an elongated rib 46 extending from each substantially-circular rib 44 to a neighboring substantially-circular rib 44.

In one arrangement of the second expression of the embodiment of FIGS. 1-4, the first shell 12 has a longitudinal axis 30, wherein a first cross-sectional view (seen in FIG. 3) of the first shell 12 taken by a first cutting plane perpendicular to the longitudinal axis 30 shows at least one convex region 28 surrounded by two adjoining concave regions 26, and wherein a second cross-sectional view (seen in FIG. 4) of the first shell 12 taken by a second cutting plane containing the longitudinal axis 30 and perpendicular to the first cutting plane shows at least one convex region 28 surrounded by two adjoining concave regions 26.

A third expression of the embodiment FIGS. 1-4 is for apparatus including a motor-vehicle, internal-combustion-engine air intake manifold 10 having an intake-manifold first shell 12 attachable to an intake-manifold second shell 18 to surround an internal manifold volume 20. The first shell 12 has a wall 22 with at least a portion 24 having undulating concave and convex regions 26 and 28 as defined exterior to the internal manifold volume 20 of the attached first shell 12 and second shell 18. The first shell 12 has a plurality of fixing locations 14, wherein the first shell 12 is attachable at the fixing locations to the second shell 18, and wherein the fixing locations 14 are centered on the centers 40 of the concave regions 26.

In one arrangement of the third expression of the embodiment of FIGS. 1-4, the first shell 12 has a longitudinal axis 30, wherein a first cross-sectional view (seen in FIG. 3) of the first shell 12 taken by a first cutting plane perpendicular to the longitudinal axis 30 shows at least one convex region 28 surrounded by two adjoining concave regions 26, and wherein a second cross-sectional view (seen in FIG. 4) of the first shell 12 taken by a second cutting plane containing the longitudinal axis 30 and perpendicular to the first cutting plane shows at least one convex region 28 surrounded by two adjoining concave regions 26.

Several benefits and advantages are derived from one or more or all of the expressions of the embodiment of the invention. In one example, computer aided engineering analysis of one design (which included ribs) of the embodiment of the invention yielded 80%-90% reduction in displacement and 55%-70% reduction in peak stress levels during a sudden pressurization event, compared to a conventional air intake manifold having a shell with a flat top, which should result in improved acoustical barrier properties and improved burst strength.

The foregoing description of several expressions of embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

The invention claimed is:

1. An apparatus comprising:

a motor-vehicle, internal-combustion-engine air intake manifold including an intake-manifold first shell attachable or monolithically joined to an intake-manifold second shell to surround an internal manifold volume, wherein the first shell has a wall with at least a portion having undulating concave and convex regions as defined exterior to the internal manifold volume of the attached or monolithically-joined first shell and second shell;

wherein the first shell has a longitudinal axis, and wherein a first cross-sectional view of the first shell taken by a first cutting plane perpendicular to the longitudinal axis shows at least one convex region surrounded by two adjoining concave regions;

wherein a second cross-sectional view of the first shell taken by a second cutting plane containing the longitudinal axis and perpendicular to the first cutting plane shows at least one convex region surrounded by two adjoining concave regions;

wherein the convex regions each have a center, and wherein the centers of the convex regions lie substantially in a first plane;

wherein the concave regions each have a center, and wherein the centers of the concave regions lie substantially in a second plane parallel to, and spaced apart from, the first plane;

wherein the first shell has a plurality of substantially-circular ribs each surrounding and concentric with the center of a corresponding concave region.

2. The apparatus of claim 1, wherein the first shell includes a perimeter rim, and wherein the perimeter rim lies substantially in a third plane parallel to, and spaced apart from, the first and second planes, wherein the second plane is disposed between the first and third planes.

3. The apparatus of claim 2, wherein the first plane is spaced apart a distance Dl from the third plane, wherein the second plane is spaced apart a distance D2 from the third plane, and wherein D2/D1 is between and including 0.50 and 0.75.

4. The apparatus of claim 1, wherein the first shell has an elongated rib extending from each substantially-circular rib to a neighboring substantially-circular rib.

5. The apparatus of claim 4, wherein the elongated ribs each have a top surface, and wherein at least ninety percent of the top surface of each elongated rib lies substantially in the first plane.

6. The apparatus of claim 5, wherein the first shell has a plurality of fixing locations, wherein the first shell is attachable at the fixing locations to the second shell, and wherein the fixing locations are centered on the centers of the concave regions.

7. The apparatus of claim 6, wherein the centers of the concave regions include first, second, third, and fourth centers defining corners of a square.

8. The apparatus of claim 7, wherein a line drawn between the first and second centers and a line drawn between the third and fourth centers each are substantially parallel to the longitudinal axis.

9. The apparatus of claim 5, wherein the first shell has a plurality of fixing locations, wherein the first shell is attachable at the fixing locations to the second shell, and wherein the fixing locations are disposed proximate the perimeter rim.

10. The apparatus of claim 9, wherein the centers of the concave regions include first, second, third, and fourth centers defining corners of a rectangle.

11. The apparatus of claim 10, wherein a line drawn between the first and second centers and a line drawn between the third and fourth centers each are substantially parallel to the longitudinal axis.

12. An apparatus comprising a motor-vehicle, internal-combustion-engine air intake manifold including an intake-manifold first shell attachable or monolithically joined to an intake-manifold second shell to surround an internal manifold volume, wherein the first shell has a wall with at least a portion having undulating concave and convex regions as defined exterior to the internal manifold volume of the attached or monolithically-joined first shell and second shell, wherein the first shell has a plurality of substantially-circular ribs each surrounding and concentric with a center of a corresponding concave region, and wherein the first shell has an elongated rib extending from each substantially-circular rib to a neighboring substantially-circular rib.

13. The apparatus of claim 12, wherein the first shell has a longitudinal axis, wherein a first cross-sectional view of the first shell taken by a first cutting plane perpendicular to the longitudinal axis shows at least one convex region surrounded by two adjoining concave regions, and wherein a second cross-sectional view of the first shell taken by a second cutting plane containing the longitudinal axis and perpendicular to the first cutting plane shows at least one convex region surrounded by two adjoining concave regions.

14. An apparatus comprising a motor-vehicle, internal-combustion-engine air intake manifold including an intake-manifold first shell attachable to an intake-manifold second shell to surround an internal manifold volume, wherein the first shell has a wall with at least a portion having undulating concave and convex regions as defined exterior to the internal manifold volume of the attached first shell and second shell, wherein the first shell has a plurality of fixing locations, wherein the first shell is attachable at the fixing locations to the second shell, and wherein the fixing locations are centered on the centers of the concave regions.

15. The apparatus of claim 14, wherein the first shell has a longitudinal axis, wherein a first cross-sectional view of the first shell taken by a first cutting plane perpendicular to the longitudinal axis shows at least one convex region surrounded by two adjoining concave regions, and wherein a second cross-sectional view of the first shell taken by a second cutting plane containing the longitudinal axis and perpendicular to the first cutting plane shows at least one convex region surrounded by two adjoining concave regions.

16. An apparatus comprising:

a motor-vehicle, internal-combustion-engine air intake manifold including an intake-manifold first shell attachable or monolithically joined to an intake-manifold second shell to surround an internal manifold volume, wherein the first shell has a wall with at least a portion having undulating concave and convex regions as defined exterior to the internal manifold volume of the attached or monolithically-joined first shell and second shell, a longitudinal axis, and a perimeter rim;

wherein a first cross-sectional view of the first shell taken by a first cutting plane perpendicular to the longitudinal axis shows at least one convex region surrounded by two adjoining concave regions, and a second cross-sectional view of the first shell taken by a second cutting plane containing the longitudinal axis and perpendicular to the first cutting plane shows at least one convex region surrounded by two adjoining concave regions;

wherein the convex regions each have a center, which all lie substantially in a first plane;

wherein the concave regions each have a center, which all lie substantially in a second plane parallel to, and spaced apart from, the first plane;

wherein the first shell includes a perimeter rim that lies substantially in a third plane parallel to, and spaced apart from, the first and second planes, wherein the second plane is disposed between the first and third planes;

wherein the first plane is spaced apart a distance D1 from the third plane, wherein the second plane is spaced apart a distance D2 from the third plane, and wherein D2/D1 is between and including 0.50 and 0.75; and wherein the first shell has a plurality of substantially-circular ribs each surrounding and concentric with the center of a corresponding concave region.

* * * * *